US007607666B1

(12) United States Patent
Studier

(10) Patent No.: US 7,607,666 B1
(45) Date of Patent: Oct. 27, 2009

(54) CORN TOSS GAME

(76) Inventor: Robert A Studier, 7641 NW. 23rd St., Margate, FL (US) 33063

( * ) Notice: Subject to any disclaimer, the term of this patent is extended or adjusted under 35 U.S.C. 154(b) by 0 days.

(21) Appl. No.: 12/017,173

(22) Filed: Jan. 21, 2008

(51) Int. Cl.
*A63B 63/00* (2006.01)
*A63F 1/18* (2006.01)

(52) U.S. Cl. ..... 273/400; 116/222

(58) Field of Classification Search ..... 273/398–402; 116/222
See application file for complete search history.

(56) References Cited

U.S. PATENT DOCUMENTS

| | | | | | |
|---|---|---|---|---|---|
| 285,396 | A | * | 9/1883 | DeWindt | 273/382 |
| 406,342 | A | * | 7/1889 | Dumont | 273/402 |
| 922,717 | A | * | 5/1909 | Parker | 273/401 |
| 1,636,920 | A | * | 7/1927 | Nichols | 273/402 |
| 3,139,281 | A | * | 6/1964 | Nicholson | 473/414 |
| 3,628,793 | A | * | 12/1971 | Mudloff | 273/402 |
| 3,837,650 | A | * | 9/1974 | Haney | 273/402 |
| 4,012,042 | A | * | 3/1977 | Blasingame | 273/401 |
| 4,323,250 | A | * | 4/1982 | Lansberry | 273/400 |
| 4,709,929 | A | | 12/1987 | Mills et al. | |
| 4,938,485 | A | * | 7/1990 | Hockridge et al. | 273/401 |
| 4,943,065 | A | * | 7/1990 | DeLapa | 273/402 |
| 4,961,586 | A | * | 10/1990 | Conville | 273/402 |
| 5,050,889 | A | * | 9/1991 | Walker | 273/402 |
| 5,056,796 | A | * | 10/1991 | Conville | 273/402 |
| 5,056,797 | A | * | 10/1991 | Hockert et al. | 273/402 |
| 5,165,695 | A | * | 11/1992 | Yoder | 273/402 |
| 5,201,527 | A | * | 4/1993 | Koket | 273/402 |
| D340,082 | S | * | 10/1993 | DeLapa | D21/303 |
| 5,332,230 | A | * | 7/1994 | Benedict | 473/594 |
| D375,530 | S | * | 11/1996 | Rudd | D21/303 |
| 5,765,832 | A | * | 6/1998 | Huff | 273/354 |
| D406,179 | S | * | 2/1999 | Thompson et al. | D21/304 |
| 5,871,216 | A | | 2/1999 | Sparacino | |
| D408,462 | S | * | 4/1999 | Frycz | D21/303 |
| 5,909,877 | A | * | 6/1999 | Bour | 273/402 |
| 6,244,598 | B1 | * | 6/2001 | Conville | 273/402 |
| 6,464,226 | B1 | * | 10/2002 | Kephart | 273/401 |
| D474,246 | S | * | 5/2003 | Carr | D21/303 |
| 6,932,345 | B1 | * | 8/2005 | O'Dell | 273/402 |
| 2005/0127609 | A1 | * | 6/2005 | Raslowsky | 273/402 |

* cited by examiner

*Primary Examiner*—Mark S Graham
(74) *Attorney, Agent, or Firm*—Crossley Patent Law; Mark A. Crossley

(57) ABSTRACT

A corn toss game consisting of a foldable weatherproof game apparatus having a top portion with a hole in the center and longer a rear leg pivotally affixed to the top portion, a bottom portion hingedly affixed to the top portion, a net underneath the hole to catch tossed corn-filled bags, and a fastening means for locking the game apparatus into a folded, closed position for easy transport, as well as a separate scoreboard having a hanging means rotatably secured to which score-cards are slidably affixed and having at least one integral cup holder and a plurality of corn-filled bags. The game winner is the first person or team to score a predetermined number of points, such as 21 points, by tossing corn-filled bags into the hole on the game apparatus. An alternate embodiment has a wedge-shaped game apparatus having a hole with a net.

14 Claims, 3 Drawing Sheets

CORN TOSS GAME

FIELD OF THE INVENTION

The present invention relates to a bag tossing game and, more specifically, to a corn toss game consisting of a foldable weatherproof game apparatus having a top portion with a hole in the center and a longer rear leg, a net underneath the hole to catch tossed bags, a bottom portion having a shorter front leg, and a fastening means for locking the apparatus into a folded, closed position for easy transport, as well as a separate scoreboard having hanging scorecards and an integral cup holder and a plurality of corn-filled bags. The game winner is the first person or team to score a predetermined number of points, such as 21 points, by tossing corn-filled bags into the hole on the game apparatus.

BACKGROUND OF THE INVENTION

Various bag tossing games and associated playing devices are provided in prior art. However, these games do not provide a folding weatherproof game apparatus which has a net underneath to catch tossed bags as well as a fastening means for locking the apparatus into position for easy and convenient transport, while also providing a separate scoreboard having an integral cup holder for keeping scores of multiple players and for holding drinks of a scorekeeper and players. Bags filled with corn kernels for tossing into the hole of the game apparatus are also provided. The present corn toss game addresses the foregoing problems by providing a hinged game apparatus with an inclined outer surface and having a top portion with a hole in the center and a longer rear leg, a net underneath the hole to catch tossed bags, a bottom portion with a short front leg, and a fastening means for the locking the apparatus into closed position for easy and convenient transport, while also providing a separate scoreboard with a plurality of scorecards by which several players' scores are kept and a cup holder integrated into the scoreboard for holding players and scorekeeper drinks. The game winner is the first person or team to score a predetermined number of points, such as 21 points, by tossing corn-filled bags into the hole on the game apparatus.

SUMMARY OF THE INVENTION

The present corn toss game consists of a game apparatus, an associated scoreboard, and a plurality of corn-filed bags. The game apparatus has a top portion and a bottom portion hingedly affixed thereto form an inclined outer surface. A hole in the center of the top portion provides an opening into which each player tosses a corn bag. A net underneath the hole facilitates the reception of bags tossed at the game apparatus. The top portion has a longer rear leg pivotally affixed thereto. The rear leg folds up underneath the bottom side of the top portion. The bottom portion bends downwardly to form a shorter front leg. A fastening means for the locking the apparatus into folded, closed position is provided for easy and convenient transport. A separate scoreboard consisting of a frame with a plurality of scorecards hung therefrom and a plurality of integrated cup holders is also provided. A corn bag has a continuous outer exterior defining an interior filled with a plurality of dry corn kernels. A corn bag is constructed from weatherproof material which may feel like duck fabric. Corn-filled bags are provided in a wide variety of colors and bear a wide variety of indicia, which may be used to associate a corn bag with a player.

The present corn toss game is provided for indoor and outdoor use. The corn toss game is also provided in a variety of colors and with a variety of ornate designs. The game apparatus and scoreboard frame are preferably constructed from waterproof, ecology friendly materials, including recycled plastic. The netting is preferably constructed out of nylon. The game apparatus is provided in a variety of sizes. One embodiment consists of a game apparatus which is generally 2-feet wide, 4-feet long and ½ inch to 1 inch thick with a hole having a 6-inch diameter at the center of the top portion, approximately 9 inches down from the distal end of the top portion, with a front leg which is approximately 3½ to 4 inches long and an rear leg which is 12 inches long. This embodiment is suggested for regulation, tournament play. Another embodiment provides a tailgate version having a 2-feet wide, 3-feet long, and between ½ inch and 2-inches thick game apparatus with a hole having a 6-inch diameter at the center of the top portion, approximately 9 inches down from the distal end of the top portion. Yet another embodiment provides a game apparatus for indoor use which is 1½ feet wide, 2 feet long and either ½ inch or ¼ inch thick, which has a hole of a 3-inch diameter, which has a 2-inch long front leg, and which has a 6-inch long rear leg. Still another indoor embodiment provides a game apparatus which is 1 foot wide and 2 feet long, which has a 3-inch diameter hole, which has a 1-inch long front leg and a 4-inch long rear leg. Even another embodiment provides a full-size game apparatus which is 2 feet wide by 4 feet long and which folds in half. Still yet another embodiment provides a scoreboard which is generally 2 feet wide and 3 feet long. A retention box may also be provided instead of or in addition to the net for catching the corn-filled bags. Further, side rails may be added to the game apparatus to prevent a corn bag which is tossed, but which does not sail directly into the hole, from bouncing underneath the game apparatus.

To play the corn toss game, the game apparatus is set up at a predetermined distance opposite a second game apparatus. The distance to the game apparatus may be varied to accommodate the skill level of the players. For instance, the game apparatus may be placed a shorter distance from a second opposite game apparatus when the game is to be played by children. Each player takes a turn tossing a corn bag at a game apparatus. Each player stands behind a game apparatus and tosses a corn bag at the opposite game apparatus. The object of the present corn toss game is to toss a corn bag into the hole on the game apparatus. The first person or team to score a predetermined number of points, for example 21 points, is declared the winner. Scoring variations add versatility and challenge to the game. The game may be played by players of all ages. The game is useful for fund-raising by schools and non-profit organizations. The game may be played in local, state-wide, and national tournaments. The game should be played by age bracket. For instance, a first youth bracket is preferably ages 5 through 7 years, a second youth bracket is preferably 8 through 11 years, while a first junior bracket is preferably 12 through 14 years and a second junior bracket is preferably 15 through 18 years. An adult bracket is preferably formed of individuals who are between the ages of 18 and 61, while a senior bracket is formed of people between the ages of 62 through 75. A super senior bracket is formed of individuals who are over the age of 75, while a handicap bracket is formed of people who are over the age of 75 but who also have a physical handicap such as being blind. A special bracket is preferably provided for players who are over 75 years of age, but who are classified as having special needs.

The present corn toss game may be played on a wide range of generally flat surfaces including, but not limited to, shuffleboard courts. The present corn toss game is a safe and entertaining game for individuals of a wide range of ages. The game also promotes physical activity and group play. The game may also be played by a varying number of players. The corn toss game assists in improving motor skills and eye-hand coordination. The present game may also be used to encourage outdoor play. The game is reasonably priced.

As such, the general purpose of the improved corn toss game which has all of the advantages of the prior art mentioned heretofore and many novel features that result in an improved corn toss game which is not anticipated, rendered obvious, suggested, or even implied by the prior art, either alone or in combination thereof.

An object of the present corn toss game is to provide a foldable game apparatus having a top portion with a hole in the center into which a corn bag is tossed, a net underneath the hole to catch tossed bags, and a fastening means for locking the apparatus into a folded, closed position for easy transport, as well as a separate scoreboard having an integral cup holder and corn-filled bags.

Another object of the present corn toss game is to provide a game which may be played by a wide range of ages.

Yet another object of the present corn toss game is to provide safe and entertaining game.

Still another object of the present game is to provide a game which may be played indoors and outdoors.

Still yet another object of the present corn toss game is to provide a game which may be played on a wide variety of surfaces.

Even another object of the present game is to promote physical activity.

Even still another object of the present corn toss game is to encourage group play.

Even yet another object of the present game is to provide a game which is reasonably priced.

Even still yet another object of the present game is to provide a game apparatus and scoreboard which are constructed from durable, weatherproof, ecology-friendly materials.

Thus has been broadly outlined the more important features of the improved corn toss game so that the detailed description thereof that follows may be better understood and in order that the present contribution to the art may be better appreciated.

These together with additional objects, features and advantages of the improved corn toss game will be readily apparent to those of ordinary skill in the art upon reading the following detailed description of presently preferred, but nonetheless illustrative, embodiments of the improved corn toss game when taken in conjunction with the accompanying drawings. In this respect, before explaining the current embodiments of the improved corn toss game in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved corn toss game. It is therefore important that the claims be regarded as including such equivalent constructions insofar as they do not depart from the spirit and scope of the present invention.

Objects of the improved corn toss game, along with various novel features that characterize the invention are particularly pointed out in the claims forming a part of this disclosure. For better understanding of the improved corn toss game, its operating advantages and specific objects attained by its uses, refer to the accompanying drawings and description.

DETAILED DESCRIPTION OF THE DRAWINGS

With reference now to the drawings, and in particular FIGS. 1 through 5 thereof, examples of the employing the principles and concepts of the present corn toss game, generally designated by the reference number 10, will be described.

Figure 1:
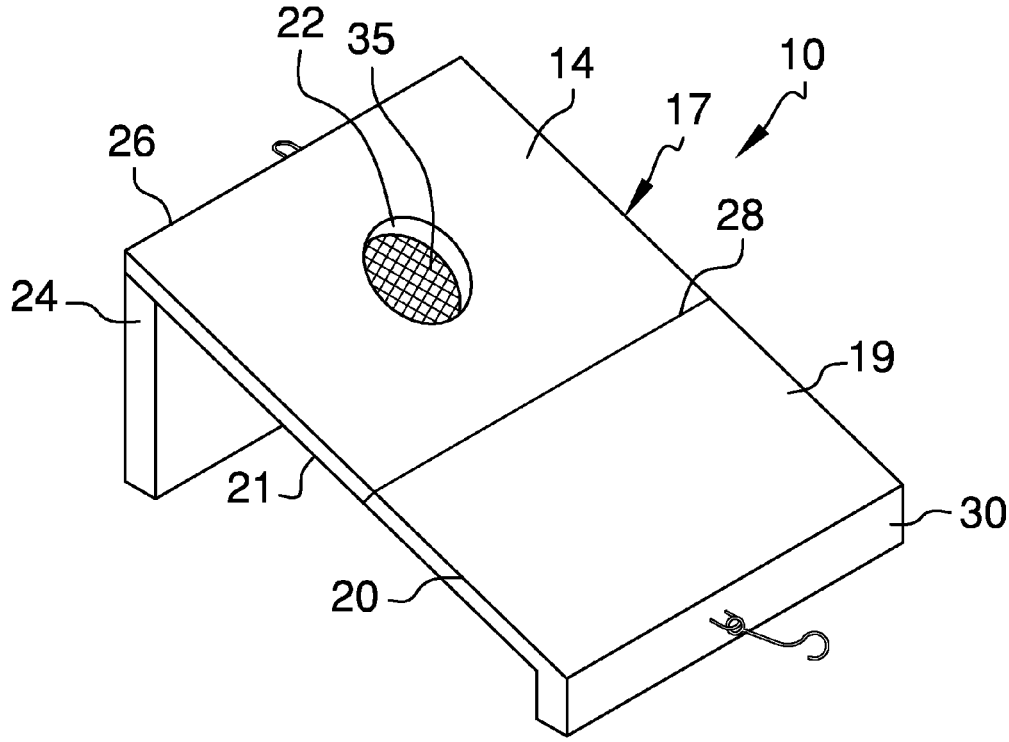
FIG. 1 is a left side isometric view of a game apparatus.
Figure 2:
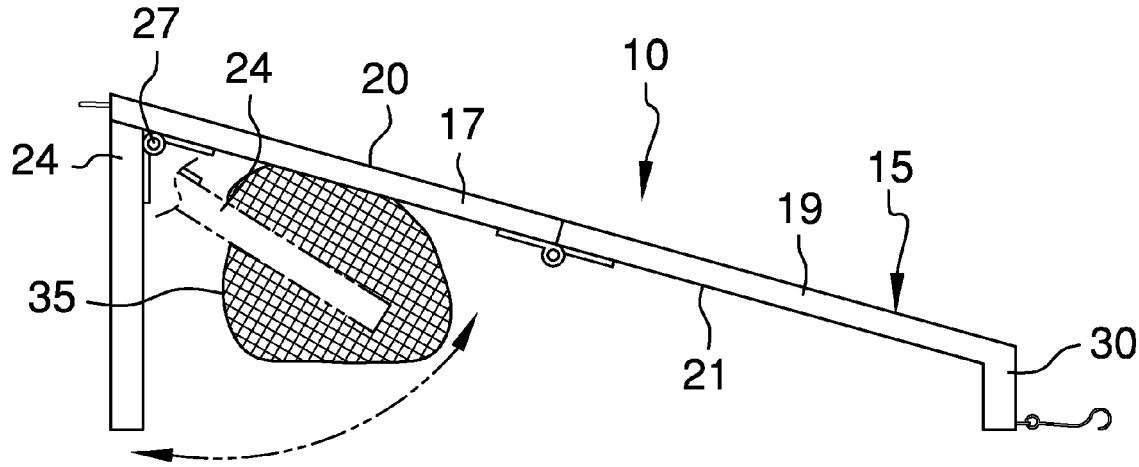
FIG. 2 is a left elevation view thereof.
Figure 3:
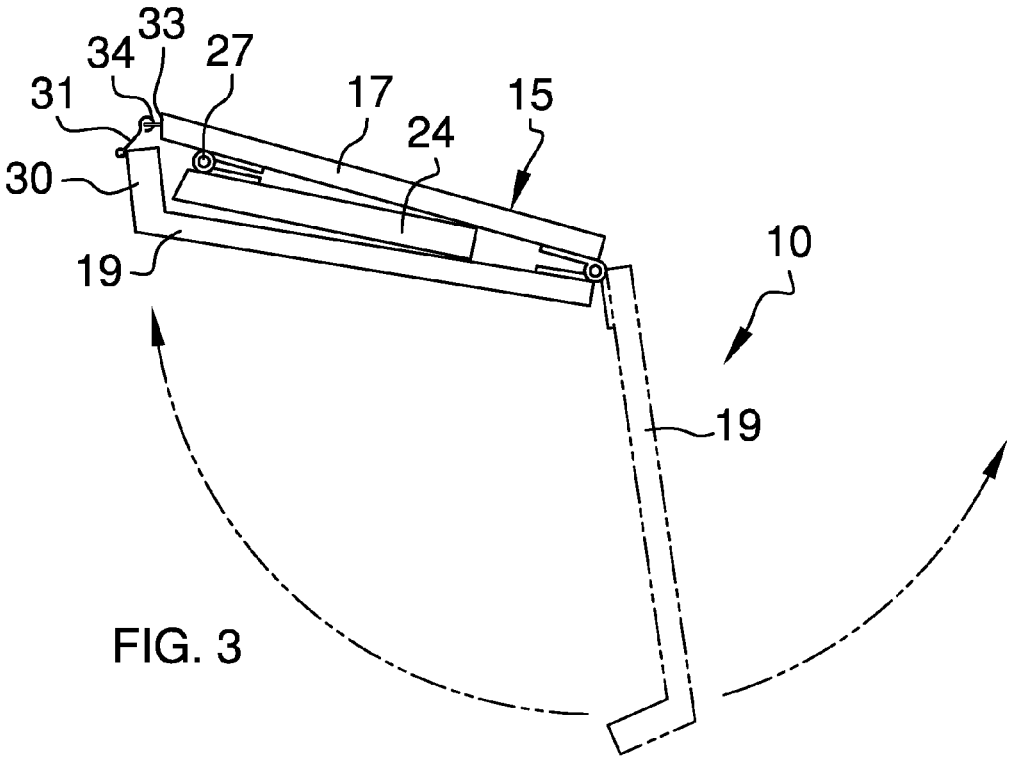
FIG. 3 is a left elevation view thereof illustrated in a folded position.

Referring to FIGS. 1 through 5, the present corn toss game 10 consists of a game apparatus 15, an associated scoreboard 60, and a plurality of corn-filled bags 80. The game apparatus 15 consists of a top portion 17 having a distal end 26 and an opposite proximal end 28 and a bottom portion 19 hingedly affixed thereto at the proximal end 28 continuously along a horizontal axis to form an inclined outer surface 20. The game apparatus 15 also has an inner surface 21. A hole 22 in the center of the top portion 17 accommodates a corn bag 80 tossed therein. A net 35 continuously affixed to the bottom of the hole 22 diameter is positioned underneath the hole 22 to accommodate the reception of bags tossed at the game apparatus. The top portion 22 has a longer rear leg 24 which is pivotally affixed at a pivot point 27 to the inner surface 21 at the distal end 26 of the top portion 17 to accommodate folding of the rear leg 24 in a position adjacent to the inner surface 21 as illustrated in FIG. 3. The bottom portion 19 bends downwardly to form an integrated shorter front leg 30 thereby forming the inclined outer surface 20. A fastening means for the locking the apparatus into folded, closed position is provided for easy and convenient transport as illustrated in FIG. 3. One form of fastening means is illustrated in FIG. 3 as a hook 31 rotatably affixed to the front edge 32 of the front leg 30 and a loop 34 affixed to a rear edge 33 of the top portion 17 wherein the hook 31 removably hooks into said loop 34.

Figure 4:
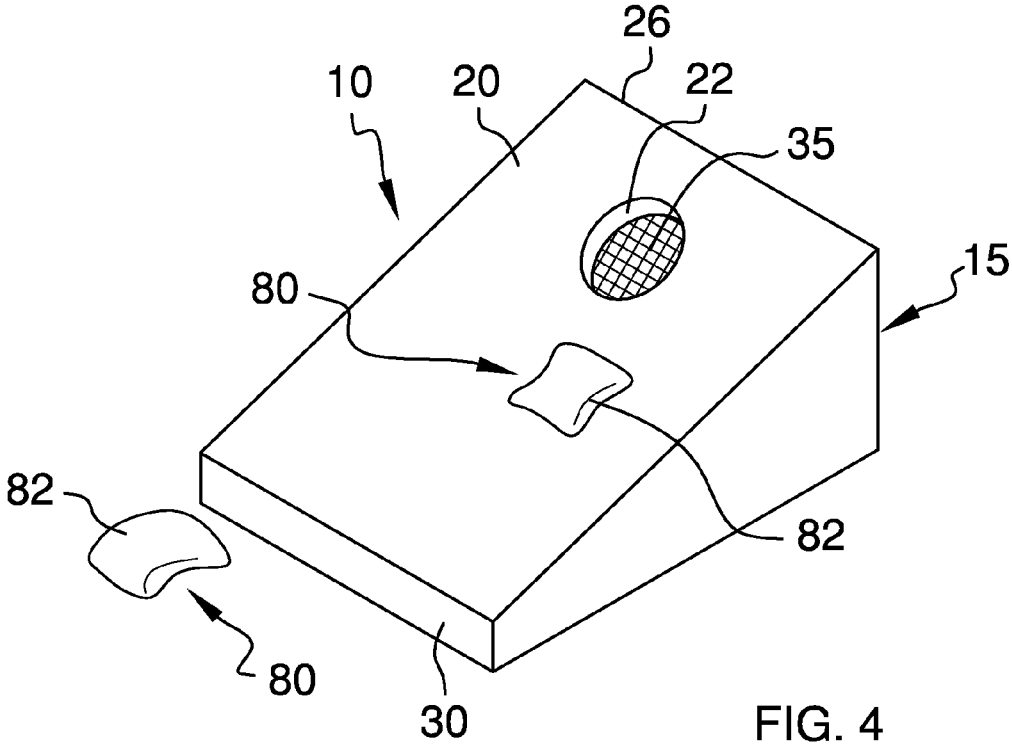
FIG. 4 is a right elevation view of an alternate embodiment.

An alternate embodiment of a game apparatus 15 is illustrated in FIG. 4, wherein the game apparatus 15 is a solitary wedge having a hole 22 in the outer surface 20 near the distal end 26. A net 35 is continuously affixed to the bottom of the hole 22 diameter. A plurality of corn-filled bags 80 are illustrated in FIG. 4. A corn bag 80 has a continuous exterior 82 defining an interior (not illustrated) filled with corn kernels or similar lightweight smooth objects, such as beans. A corn bag 80 exterior 82 is constructed from weatherproof material and having the feel of duck fabric. A corn bag 80 outer exterior 82 may be provided in a wide variety of colors and bear a wide variety of indicia, which may be used to associate a corn bag 80 with a player.

Figure 5:
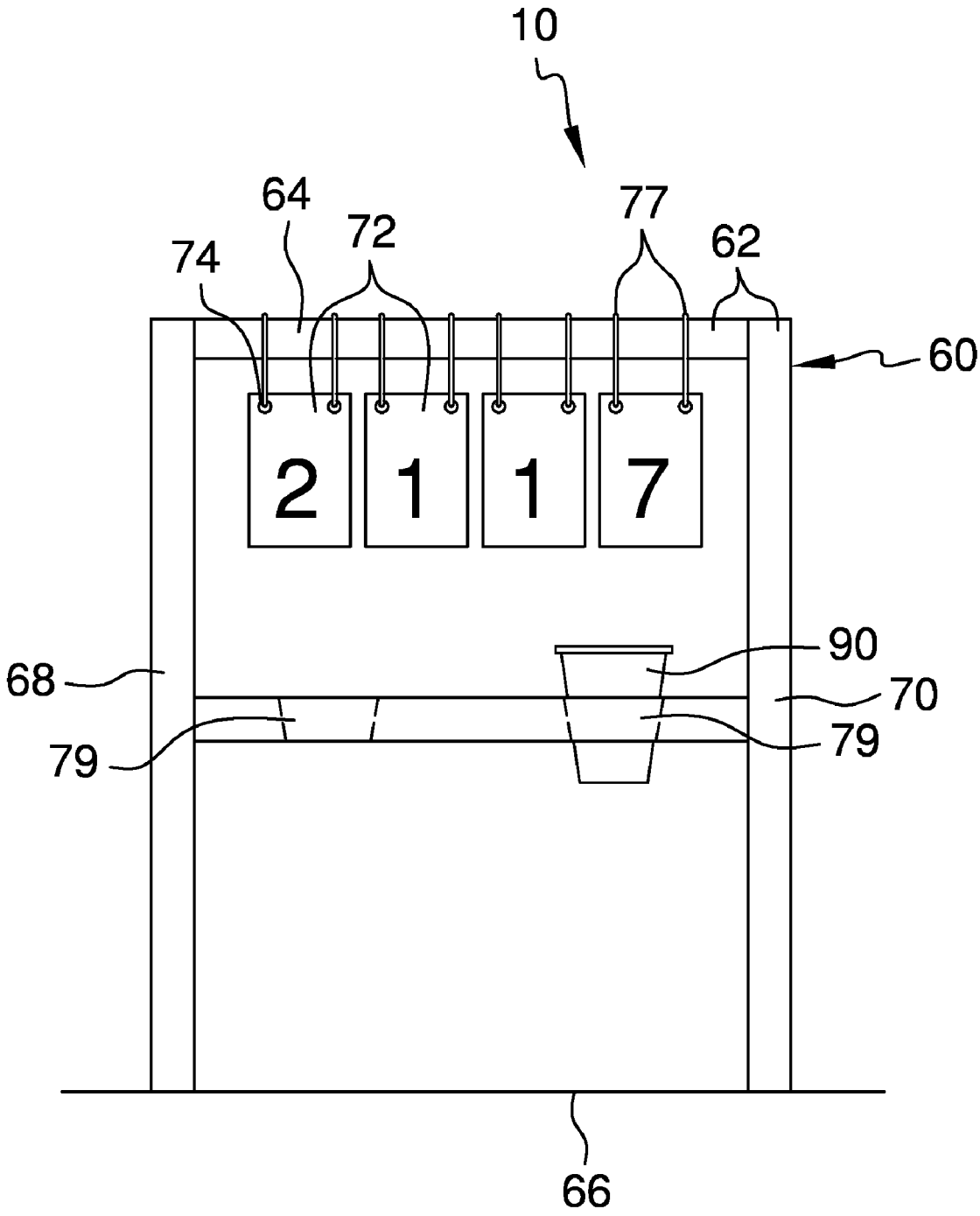
FIG. 5 is a front elevation view of a scoreboard.

A separate scoreboard 60, illustrated in FIG. 5, consists of a parallelepiped frame 62 having a top side 64, bottom side 66, left side 68, and right side 70 and a center brace 72 running continuously between said left side 68 and said right side 70. A plurality of scorecards 75 each bear numbered indicia from 0 through 9 and have at least one small aperture 74 adapted to slidably receive a hanging means 77. The hanging means 77 is rotatably secured around the top side 64 of the frame 62 and through the at least one aperture 74 of each scorecard 75. The hanging means 77 may be a cord adapted to slidably engage the at least one aperture 74, as illustrated in FIG. 5. At least one conical opening 79 adapted to hold a cup 90 in vertical position is integrated into the center brace 72 of the frame 60.

The game apparatus 15 and scoreboard 60 frame 62 are preferably constructed from waterproof, ecology friendly materials, which includes recycled plastic. The net 35 is preferably constructed out of durable nylon. The game apparatus 15 is provided in a variety of sizes. One embodiment consists of a game apparatus which is generally 2-feet wide, 4-feet long and ½ inch to 1 inch thick with a hole having a 6-inch diameter at the center of the top portion, approximately 9 inches down from the distal end of the top portion, with a front leg which is approximately 3½ to 4 inches long and an rear leg which is 12 inches long. This embodiment is suggested for regulation, tournament play. Another embodiment provides a tailgate version having a 2-feet wide, 3-feet long, and between ½ inch and 2-inches thick game apparatus with a hole having a 6-inch diameter at the center of the top portion, approximately 9 inches down from the distal end of the top portion. Yet another embodiment provides a game apparatus for indoor use which is 1½ feet wide, 2 feet long and either ½ inch or ¼ inch thick, which has a hole of a 3-inch diameter, which has a 2-inch long front leg, and which has a 6-inch long rear leg. Still another indoor embodiment provides a game apparatus which is 1 foot wide and 2 feet long, which has a 3-inch diameter hole, which has a 1-inch long front leg and a 4-inch long rear leg. Even another embodiment provides a full-size game apparatus which is 2 feet wide by 4 feet long and which folds in half. Still yet another embodiment provides a scoreboard which is generally 2 feet wide and 3 feet long. A retention box (not illustrated) may also be provided instead of or in addition to the net 35 for removably catching the corn-filled bags. Further, side rails (not illustrated) may be added to the game apparatus 15 to prevent a corn bag 80 which is tossed, but which does not sail directly into the hole 22, from bouncing underneath the game apparatus 15.

Rules of Game Play:

To play the corn toss game 10, the game apparatus 15 is set up at a predetermined distance opposite a second game apparatus 15 on a flat surface. The distance to the game apparatus 15 may be varied to accommodate the skill level of the players. For instance, the game apparatus 15 may be placed a shorter distance from a second opposite game apparatus 15 when the game is to be played by children. Each player takes a turn tossing a corn bag 80 at a game apparatus 15. Each player stands behind a game apparatus 15 and tosses a corn bag 80 at the opposite game apparatus 15. The object of the present corn toss game 10 is to toss a corn bag 80 into the hole 22 on the game apparatus 15. The first person or team to score a predetermined number of points, for example 21 points, is declared the winner. Scoring variations add versatility and challenge to the game. The game may be played by players of all ages. The game is useful for fund-raising by schools and non-profit organizations. The game may be played in local, state-wide, and national tournaments. The game may be played by age bracket. For instance, a toddler bracket is formed of children less than 5 years of age while a first youth bracket is preferably ages 5 through 7 years. A second youth bracket consists preferably of 8 through 11 year-olds, while a first junior bracket is preferably 12 through 14 years and a second junior bracket is preferably 15 through 18 years of age. An adult bracket is preferably formed of individuals who are between the ages of 19 and 61, while a senior bracket is formed of people between the ages of 62 through 75. A super senior bracket is formed of individuals who are over the age of 75, while a handicap bracket is formed of people who are over the age of 75 but who also have a physical handicap such as being blind. A special bracket is preferably provided for players who are over 75 years of age, but who are classified as having special needs.

With respect to the above description then, it is to be realized that the optimum dimensional relationships for the parts of the corn toss game, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A corn toss game comprising, in combination:

a game apparatus having an inner surface and an inclined outer surface, said game apparatus further comprising:

a bottom portion hingedly affixed to a proximal end continuously along a horizontal axis and bending downwardly to form a shorter front leg;

a top portion having a distal end, said proximal end opposite said distal end, a hole in the center adapted to receive a bag tossed therein, and an elongated rear leg pivotally affixed at a pivot point to said inner surface at the distal end of the top portion adapted to accommodate folding of rear leg in a position adjacent to said inner surface, wherein said top portion and bottom portion form said inclined outer surface when in extended position;

a net continuously affixed to a bottom edge of a diameter of said hole, wherein said net is positioned underneath said hole to accommodate the reception of bags tossed at said game apparatus; and a fastening means adapted to lock said game apparatus into a folded, closed position;

a scoreboard further comprising:

a parallelepiped frame having a top side, bottom side, left side, right side, and a center brace running continuously between said left side and said right side;

a plurality of scorecards each bearing numbered indicia from 0 through 9 and having at least one small aperture adapted to slidably receive a hanging means;

a hanging means rotatably secured around said top side of said frame and adapted to slidably engage said aperture; and at least one conical opening integrated into said center brace of said frame, said opening adapted to hold a cup in vertical position; and a plurality of bags having a continuous waterproof exterior defining an interior filled with a plurality of corn kernels.

2. The corn toss game of claim 1 wherein said fastening means is a hook rotatably affixed to the front edge of the front leg and a loop affixed to a rear edge of the top portion, said loop adapted to removably receive said hook and wherein said hanging means is a cord adapted to slidably engage said aperture.

3. The corn toss game of claim 1 wherein each of said bag bears indicia adapted to associate a bag to a player.

4. The corn toss game of claim 1 wherein said game apparatus is adapted for tournament play and further wherein:

said game apparatus is 2 feet wide, 4 feet long and has a thickness in a range from ½ inch to 1 inch;

said hole has a diameter of 6 inches;

said front leg has a length in range from 3½ inches to 4 inches;

said rear leg has a length in a range from 11½ inches to 12 inches; and said frame of said scoreboard is 2 feet wide, 3 feet long, and has a thickness in a range from ½ to 1 inch.

5. The corn toss game of claim 1 wherein:

said game apparatus is 1 foot wide, 2 feet long, and has thickness in a range from ½ to 1 inch;

said hole has a 3-inch diameter;

said front leg has a length of 1 inch; and said rear leg has a length of 4 inches.

6. The corn toss game of claim 1 wherein said game apparatus is adapted for pickup truck tailgate use and further wherein:

said game apparatus is 2 feet wide, 3 feet long, and has a thickness of a range from ½ inch to 2 inches; and said hole has a 6-inch diameter.

7. The corn toss game of claim 1 wherein said game apparatus is adapted for indoor use and further wherein:

said game apparatus is 1½ feet wide, 2 feet long and ranges in thickness from ¼ inch to ½ inch;

said hole has a 3-inch diameter;

said front leg has a length of 2 inches; and said rear leg has a length of 6 inches.

8. The corn toss game of claim 4 wherein said game apparatus and said scoreboard are constructed from recycled plastics and said net is constructed from nylon.

9. The corn toss game of claim 5 wherein said game apparatus and said scoreboard are constructed from recycled plastics and said net is constructed from nylon.

10. The corn toss game of claim 6 wherein said game apparatus and said scoreboard are constructed from recycled plastics and said net is constructed from nylon.

11. The corn toss game of claim 7 wherein said game apparatus and said scoreboard are constructed from recycled plastics and said net is constructed from nylon.

12. A corn toss game comprising, in combination:

a solitary, wedge-shaped game apparatus having an outer surface, an inner surface, a distal end and a front edge, said game apparatus further comprising:

a hole in said outer surface near said distal end a net continuously affixed to the bottom of the hole diameter;

a plurality of bags having continuous exterior defining an interior filled with a plurality of corn kernels; and a scoreboard further comprising:

a parallelepiped frame having a top side, bottom side, left side, right side, and a center brace running continuously between said left side and said right side;

a plurality of scorecards each bearing numbered indicia from 0 through 9 and having at least one small aperture adapted to slidably receive a hanging means;

a hanging means rotatably secured around said top side of said frame and through the at least one aperture of each scorecard; and at least one conical opening integrated into said center brace of said frame, said opening adapted to hold a cup in vertical position.

13. The corn toss game of claim 12 wherein said hanging means is a cord adapted to slidably engage said aperture.

14. The corn toss game of claim 12 wherein each of said bag bears indicia adapted to associate a bag to a player.

* * * * *